US009644396B2

(12) United States Patent
Grow et al.

(10) Patent No.: US 9,644,396 B2
(45) Date of Patent: May 9, 2017

(54) SYSTEMS AND METHODS FOR MODULAR LOCKING

(71) Applicant: Kiosk Information Systems, Inc., Louisville, CO (US)

(72) Inventors: Roger H. Grow, Lafayette, CO (US); Richard L. Malone, Lafayette, CO (US); Charles Newsom, Littleton, CO (US); Wayne R. Hemzacek, Westminster, CO (US)

(73) Assignee: Kiosk Information Systems, Inc., Louisville, CO (US)

( * ) Notice: Subject to any disclaimer, the term of this patent is extended or adjusted under 35 U.S.C. 154(b) by 68 days.

(21) Appl. No.: 14/155,171

(22) Filed: Jan. 14, 2014

(65) Prior Publication Data

US 2014/0196510 A1 Jul. 17, 2014

Related U.S. Application Data

(60) Provisional application No. 61/752,340, filed on Jan. 14, 2013.

(51) Int. Cl.
*E05B 47/00* (2006.01)
*E05B 17/00* (2006.01)
(Continued)

(52) U.S. Cl.
CPC ..... *E05B 17/0025* (2013.01); *E05B 47/0012* (2013.01); *E05B 47/026* (2013.01);
(Continued)

(58) Field of Classification Search
CPC ..... Y10T 70/7062; Y10T 70/7113; Y10T 70/7051; Y10T 70/7102; Y10T 70/7107; Y10T 70/7068; Y10T 70/625; Y10T 70/713; Y10T 70/7136; Y10T 70/5155; Y10T 70/7057; Y10T 70/5199; E05B 47/0012; E05B 47/0001; E05B 47/026; E05B 47/00; E05B 47/02; E05B 47/0004; E05B 47/0603; E05B 47/0611;
(Continued)

(56) References Cited

U.S. PATENT DOCUMENTS 1,438,547 A * 12/1922 O'Connor ..... E05B 65/025 217/65
1,594,650 A * 8/1926 Vance ..... E05B 65/025 292/218
(Continued)

FOREIGN PATENT DOCUMENTS

JP H06230953 A 8/1994
WO 9619779 A9 9/1996
(Continued)

*Primary Examiner* — Suzanne Barrett
*Assistant Examiner* — Morgan McClure
(74) *Attorney, Agent, or Firm* — Faegre Baker Daniels LLP

(57) ABSTRACT

Embodiments of the present invention relate generally to a locker bay system. Specifically, in some embodiments the locker bay includes a catch loop coupled to the locker door and a locking mechanism that releaseably secures the catch loop to lock and unlock the locker bay. The locking mechanism, in some embodiments, includes a lock bar that pulls and pushes the catch loop in and out of the lock bar to lock and unlock the locker bay.

18 Claims, 13 Drawing Sheets

(51) Int. Cl.

| | |
|---|---|
| ***E05B 65/02*** | (2006.01) |
| ***G07F 17/10*** | (2006.01) |
| *E05B 47/06* | (2006.01) |
| *E05B 47/02* | (2006.01) |

(52) U.S. Cl.
CPC ..... *E05B 65/025* (2013.01); *G07F 17/10* (2013.01); *E05B 47/00* (2013.01); *E05B 47/0001* (2013.01); *E05B 47/0004* (2013.01); *E05B 47/02* (2013.01); *E05B 47/0603* (2013.01); *E05B 2047/0094* (2013.01); *Y10T 70/5199* (2015.04)

(58) Field of Classification Search
CPC ..... E05B 2047/0058; E05B 2047/0086; E05B 2047/002; E05B 2047/0031; E05B 2047/0067; E05B 2047/0023; E05B 2047/0094; E05B 2047/0016; E05B 17/0025; G07F 17/10
USPC ..... 70/277, 275, 271, 278.7, 280
See application file for complete search history.

(56) References Cited

U.S. PATENT DOCUMENTS 2,105,983 A * 1/1938 Miller ..... E05G 5/00 49/30
2,767,570 A * 10/1956 Garver ..... G07F 17/14 194/256
3,508,423 A * 4/1970 Harrell ..... E05B 35/08 292/101
5,490,245 A 2/1996 Wugofski
6,031,529 A 2/2000 Migos et al.
6,256,194 B1 * 7/2001 Choi et al. ..... G06F 1/1616 292/4
6,871,325 B1 3/2005 McNally et al.
7,062,773 B1 6/2006 Siksa et al.
7,076,332 B2 7/2006 Cifra et al.
7,131,301 B1 * 11/2006 Chang ..... E05B 35/007 70/134
7,496,053 B1 2/2009 Seabaugh et al.
7,571,113 B2 8/2009 Fettig et al.
7,624,375 B2 11/2009 Santori et al.
7,726,294 B2 * 6/2010 Collene ..... F24C 15/022 126/192
7,895,530 B2 2/2011 Leavitt et al.
8,453,109 B2 5/2013 Chupa et al.
8,677,272 B2 3/2014 Lance
8,793,588 B2 7/2014 DiPietro
8,856,667 B2 10/2014 Gaudette
8,938,685 B2 1/2015 Zavatone
9,098,294 B2 8/2015 Zavatone et al.
2002/0149623 A1 10/2002 West et al.
2008/0255901 A1 10/2008 Carroll et al.
2008/0306886 A1 12/2008 Otto et al.
2009/0071208 A1 * 3/2009 Wang ..... E05B 47/0603 70/277
2009/0228831 A1 9/2009 Wendker et al.
2009/0282879 A1 * 11/2009 Marcelle ..... E05B 47/0603 70/277
2009/0313139 A1 12/2009 Nam et al.
2010/0024496 A1 * 2/2010 Wolfish ..... E05B 47/0002 70/277
2010/0042506 A1 2/2010 Ravenel et al.
2010/0139338 A1 * 6/2010 Wintersteiger ..... E05B 47/0696 70/78
2010/0306651 A1 12/2010 Quennesson et al.
2011/0179839 A1 * 7/2011 Jeffries ..... E05C 9/042 70/345
2011/0203332 A1 * 8/2011 Suh ..... D06F 37/42 70/91
2012/0167646 A1 * 7/2012 Sharma ..... G01B 7/31 70/280
2012/0194043 A1 * 8/2012 Turner ..... G07F 7/00 312/109
2013/0025511 A1 * 1/2013 Maxwell ..... E05G 1/04 109/59 R
2013/0228104 A1 * 9/2013 Susaki ..... E05G 1/005 109/23
2013/0298618 A1 * 11/2013 Gotter ..... B25H 3/02 70/280
2013/0317986 A1 * 11/2013 Tucker ..... G07F 19/201 705/43
2013/0333426 A1 * 12/2013 Baker ..... E05B 47/00 70/280
2014/0047878 A1 * 2/2014 Zheng ..... E05B 47/0012 70/275

FOREIGN PATENT DOCUMENTS

WO 0129643 A1 4/2001
WO 2001031427 A9 7/2002
WO 2006135607 A2 12/2006

* cited by examiner

SYSTEMS AND METHODS FOR MODULAR LOCKING

CROSS-REFERENCE TO RELATED APPLICATION

This application claims the benefit of U.S. Provisional Patent Application Ser. No. 61/752,340, filed on Jan. 14, 2013 and entitled "SYSTEMS AND METHODS FOR MODULAR LOCKING", which is hereby incorporated by reference in its entirety.

TECHNICAL FIELD

Embodiments of the present invention relate generally to systems and methods for modular locking. In particular, embodiments of the present invention relate to locker bays that include a locking mechanism utilizing a lock bar driven by a cam wheel and motor.

BACKGROUND

Lockers allow users to temporarily store goods, either for personal use or as part of vending operations. Security measures are typically required to prevent theft or vandalism.

SUMMARY

According to some embodiments, a locker bay includes a locker door to which a catch loop is secured. The locker bay also includes a locking mechanism that receives and secures the catch loop using a lock bar driven by cam wheel. The lock bar has a catch loop aperture with a first portion that is angled with respect to a second portion of the catch loop aperture. As the cam wheel drives the lock bar, the angled first portion of the catch loop aperture forces the catch loop in and out of the catch loop aperture to lock and unlock the locker door.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Embodiments of the present invention relate generally to a locker bay system. Specifically, in some embodiments a locker bay includes a catch loop coupled to a locker door and a locking mechanism that releaseably secures the catch loop to lock and unlock the locker bay. In particular, the locking mechanism includes a lock bar that pulls and pushes the catch loop in and out of the lock bar to lock and unlock the locker bay.

Figure 1:
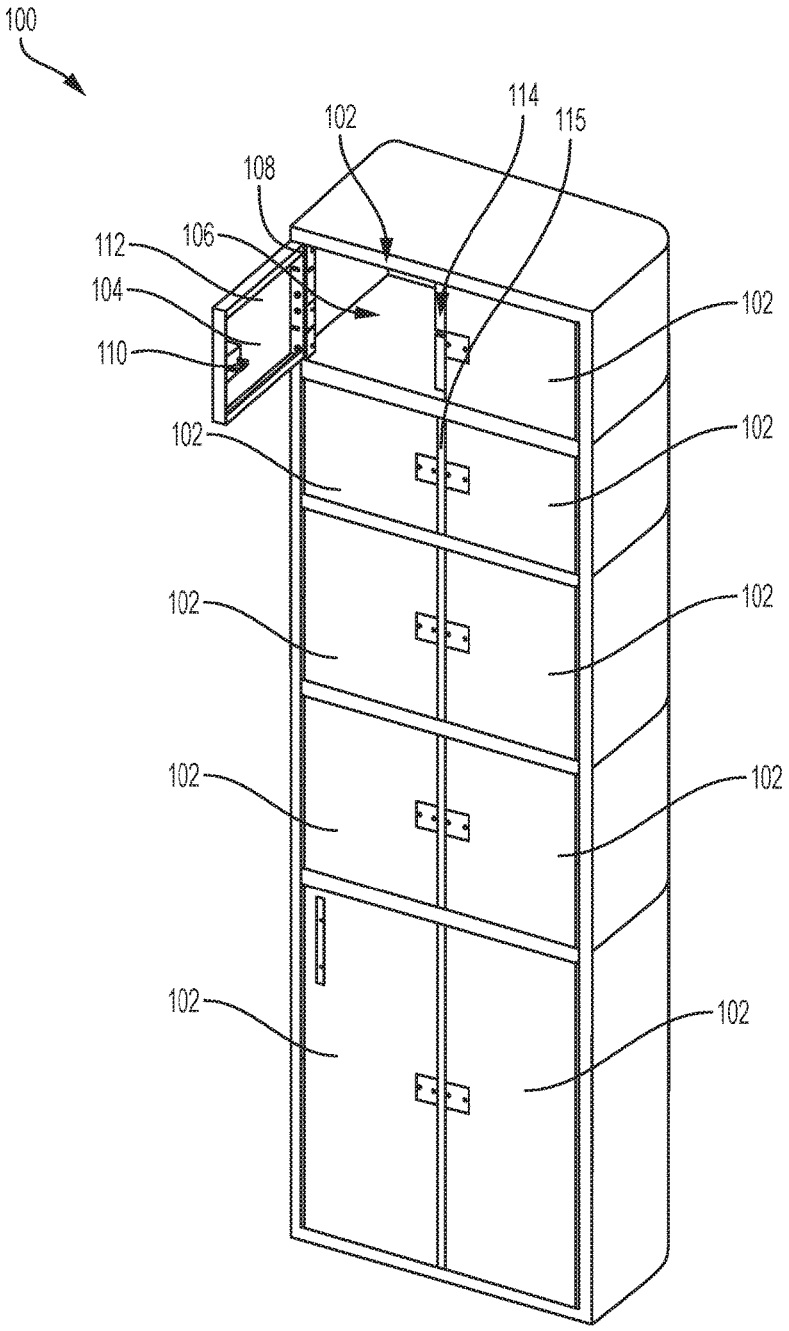
FIG. 1 illustrates a locker module that includes ten locker bays of various sizes and shapes according to embodiments of the present invention.
Figure 2:
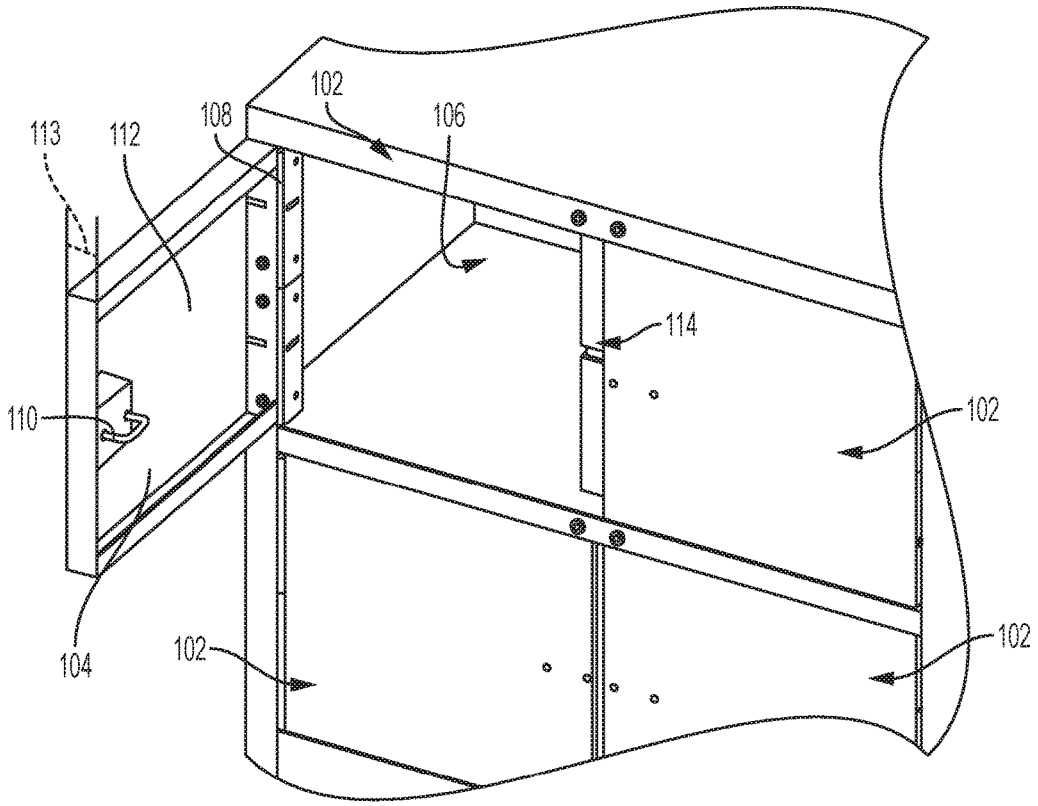
FIG. 2 illustrates a closer view of the locker module of FIG. 1 with the locker door of one of the locker bays open.
Figure 3:
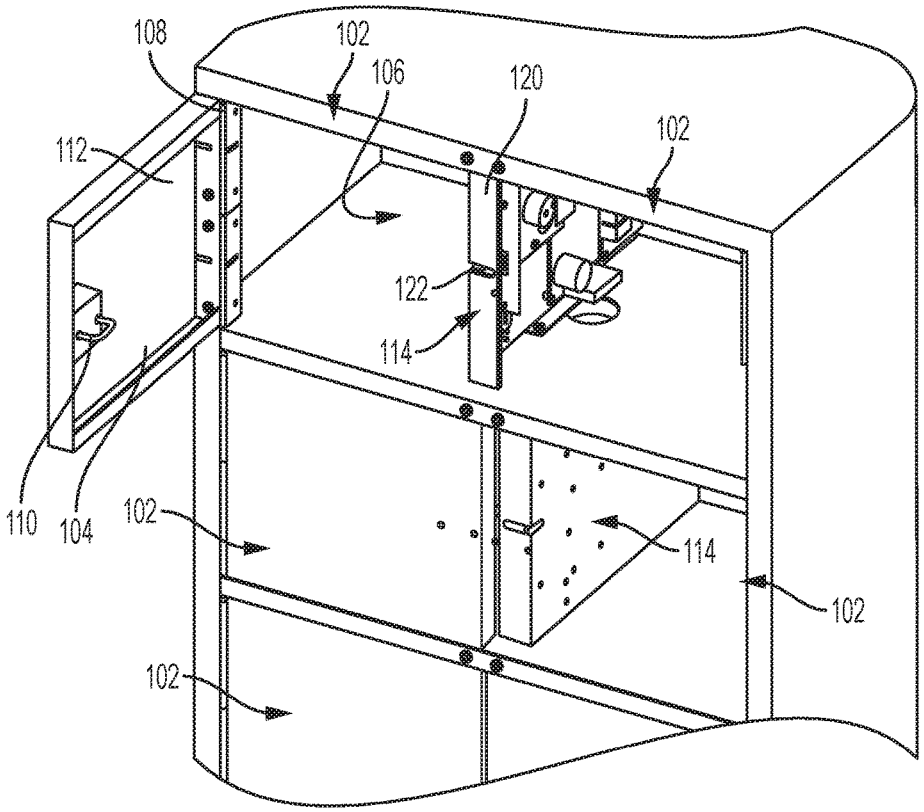
FIG. 3 illustrates a closer view of the locker module of FIG. 1 with the locker door of one of the locker bays open, with two locker doors removed, and with a locking mechanism removed for illustrative purposes.

In the embodiments shown in FIGS. 1-3, a locker module 100 includes ten locker bays 102 of various sizes and shapes. In other embodiments, the locker module 100 may include only one locker bay 102 or may include more than one or more than ten locker bays 102. Multiple locker modules 100 may be coupled together to form a locker array. The locker bays, locker modules, and/or locker arrays may include electronic and/or mechanical user interfaces. The locker bays, locker modules, and/or locker arrays may also include wired and/or wireless communication equipment to interface with remote devices (e.g., central control systems) and/or users (e.g., user mobile phones or laptops) as well as local devices (e.g., a local central control system, or other local locker bays, locker modules, or locker arrays).

The locker bay 102 includes a locker door 104 that permits access to the interior 106 of the locker bay 102. The locker door 104 includes one or more hinges 108 pivotally coupling the locker door 104 to the locker bay 102. In some embodiments, the locker door 104 is spring biased towards a closed position. In some embodiments, the locker door 104 is spring biased towards an open position. The locker door 104 also includes a catch loop 110 coupled to an interior surface 112 of the locker door 104. The locker bay 102 includes a locking mechanism 114 that receives the catch loop 110 to secure the locker door 104 in the closed position. In some embodiments, the locker door 104 includes a lip (not shown) to enable users to open the locker door 104. When the locker door 104 is in the closed position, the lip may be flush with the locker bay 102 (e.g., center bar 115 in FIG. 1) to prevent unauthorized access to the interior 106 of the locker bay 102. As shown in FIG. 3, the locking mechanism 114 includes an exterior surface 120 that has an exterior surface aperture 122 to receive the catch loop 110.

Figure 4:
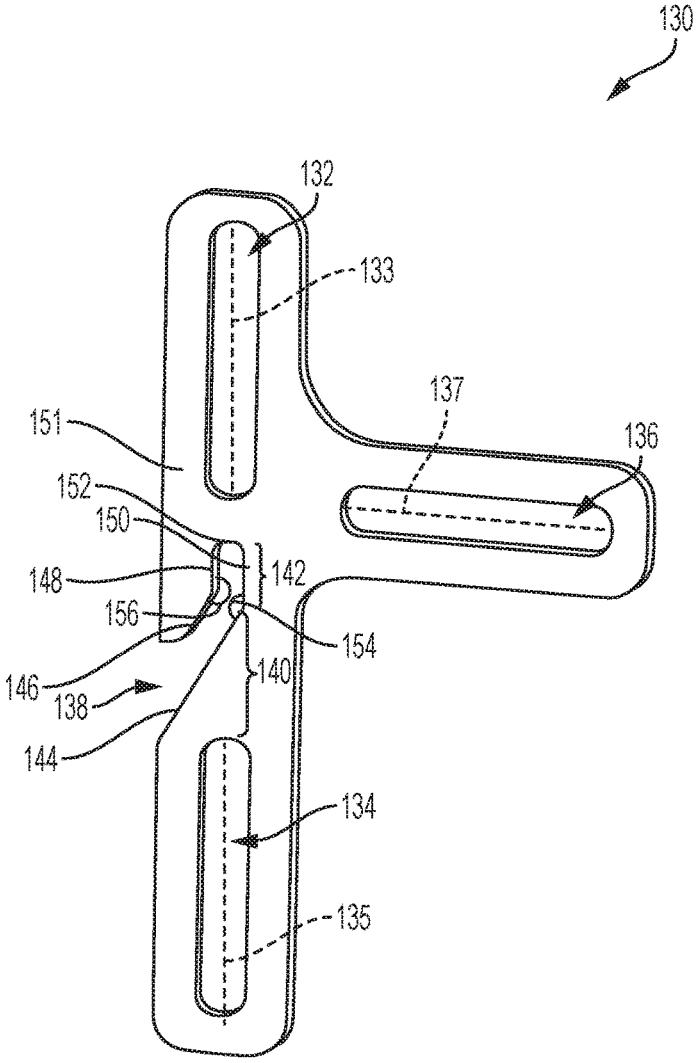
FIG. 4 illustrates a lock bar according to embodiments of the present invention.

The locking mechanism uses a lock bar 130, as shown in isolation in FIG. 4. The lock bar 130 includes a first aperture 132 and a second aperture 134. In the embodiment shown in FIG. 4, these apertures 132, 134 and form closed loops and are linearly aligned (e.g., a major axis 133 of the first aperture 132 substantially aligns with a major axis 135 of the second aperture 134). As described below in more detail, these apertures 132, 134 receive modified washers that limit the lock bar's vertical movement and prevent the lock bar 130 from moving horizontally and laterally. The lock bar 130 also includes a cam shaft aperture 136 that receives a cam shaft (178 in FIGS. 6-8) responsible for vertically sliding the lock bar 130. In some embodiments, a major axis 137 of the cam shaft aperture 136 is substantially perpendicular to the major axis 133 of the first aperture 132 and the major axis 135 of the second aperture 134.

In addition, the lock bar 130 includes a catch loop opening 138. The catch loop opening 138 includes a first section 140 connecting to a second section 142. The first section 140 of the catch loop opening 138 is bound by a first section lower surface 144 and a first section upper surface 146. The second section 142 of the catch loop opening is bound by a second section exterior side surface 148, a second section interior side surface 150, and a second section upper surface 152. In the embodiment shown in FIG. 4, the first section lower surface 144 and the second section interior side surface 150 form an angle 154 of approximately 135 degrees, as measured in a direction passing through the catch loop opening 138. The first section upper surface 146 and the second section exterior side surface 148 form an angle 156 of approximately 225 degrees, as measured in a direction passing through the catch loop opening 138. In other embodiments, the angles 154, 156 vary +/−45 degrees. As described below in more detail, the angles 154, 156 enable the lock bar 130 to push and pull the catch loop 110 out and in of the catch loop opening 138 as the lock bar 130 moves to and from the locked and unlocked positions, respectively.

Figure 5:
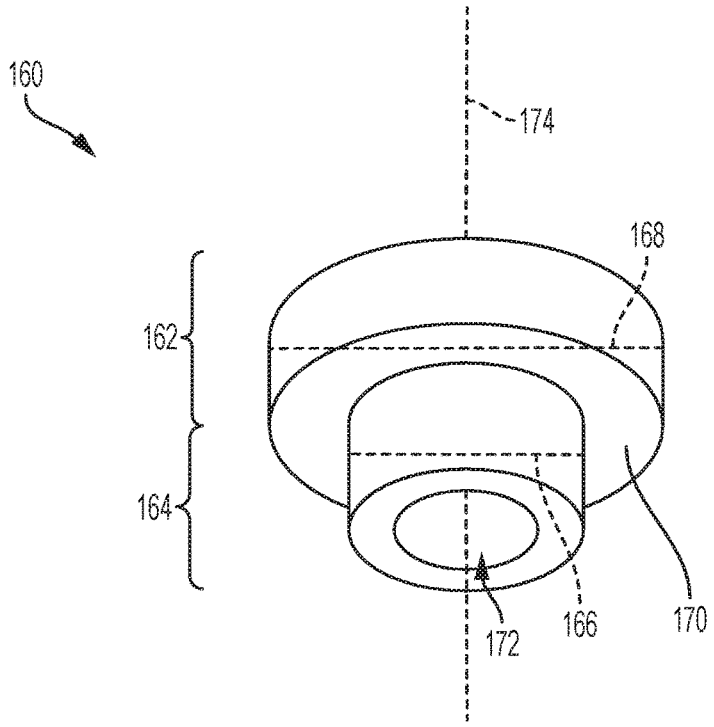
FIG. 5 illustrates a modified washer according to embodiments of the present invention.

FIG. 5 illustrates a modified washer 160. The modified washer 160 includes an upper section 162 and a lower section 164. The lower section 162 has a diameter 166 that is sized to fit within the first aperture 132 or the second aperture 134 of the lock bar 130 to prevent lateral movement. The upper section 164 has a diameter 168 that is sized so that a lower surface 170 of the upper section 164 contacts or resides over the lock bar 130 when the lower section 162 is placed within the first aperture 132 or the second aperture 134 of the lock bar 130 to prevent or limit horizontal movement of the lock bar 130. The modified washer 160 includes a central bore 172 located along a central axis 174 of the modified washer 160. The central bore 172 is sized to receive a bolt or pin to secure the modified washer 160 to the locking mechanism 114, as shown in subsequent figures.

Figure 6:
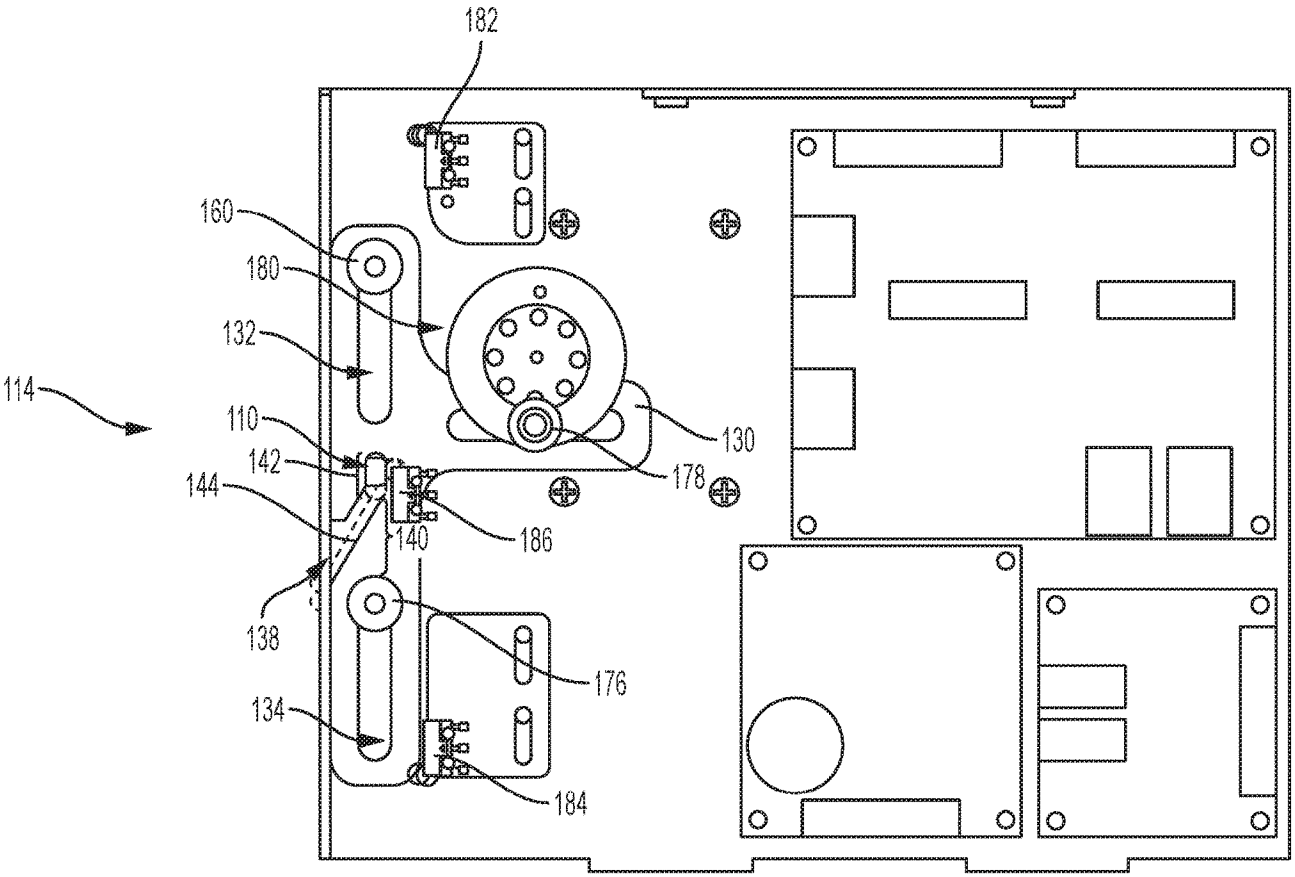
FIG. 6 illustrates a side view of components of a locking mechanism with a lock bar in a locked position according to embodiments of the present invention.
Figure 7:
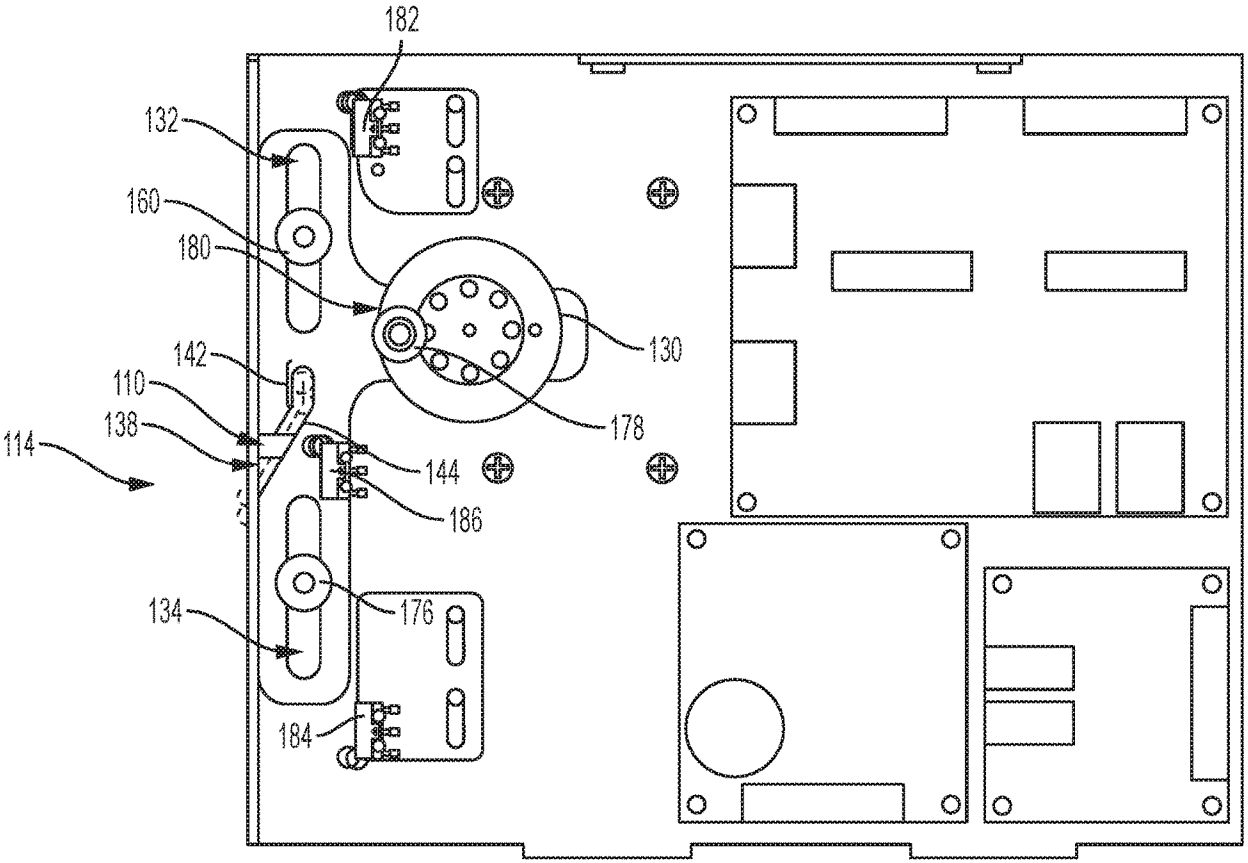
FIG. 7 illustrates the locking mechanism of FIG. 6 with the lock bar in a partially locked position.
Figure 8:
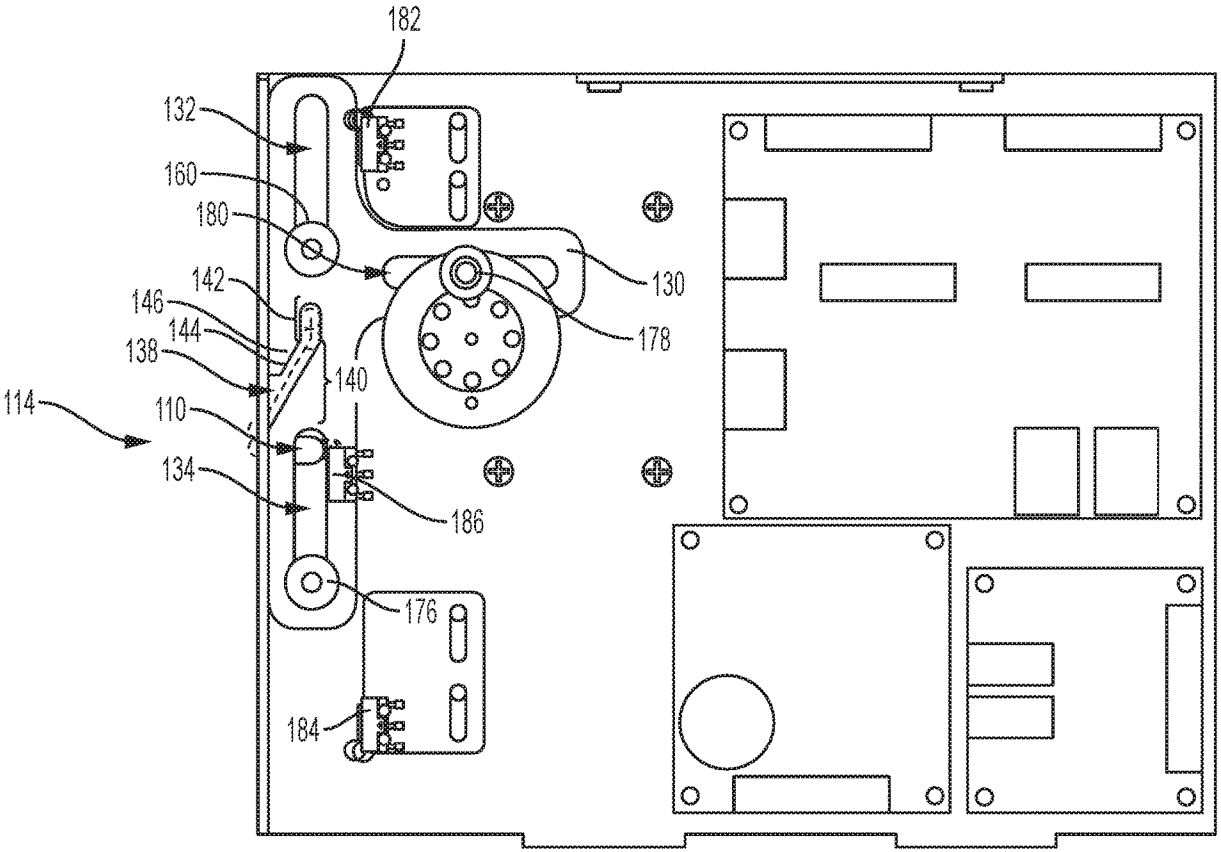
FIG. 8 illustrates the locking mechanism of FIG. 6 with the lock bar in an unlocked position.
Figure 11:
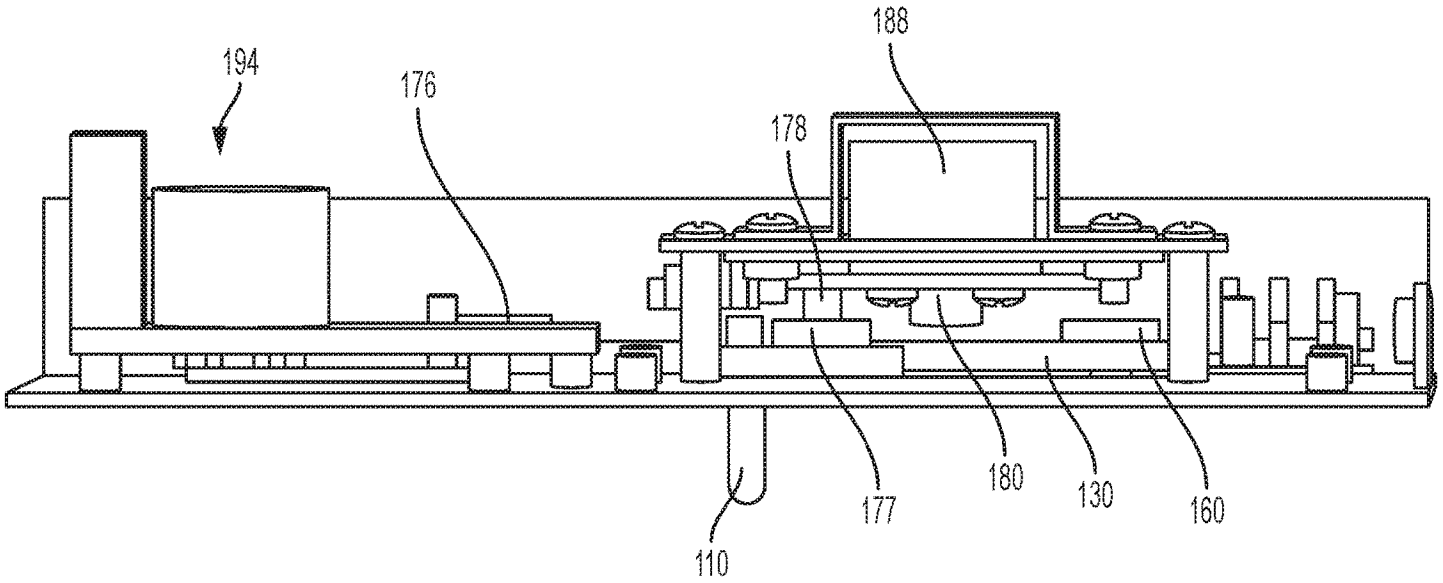
FIG. 11 illustrates a rear perspective view of components of the locking mechanism of FIG. 9.
Figure 12:
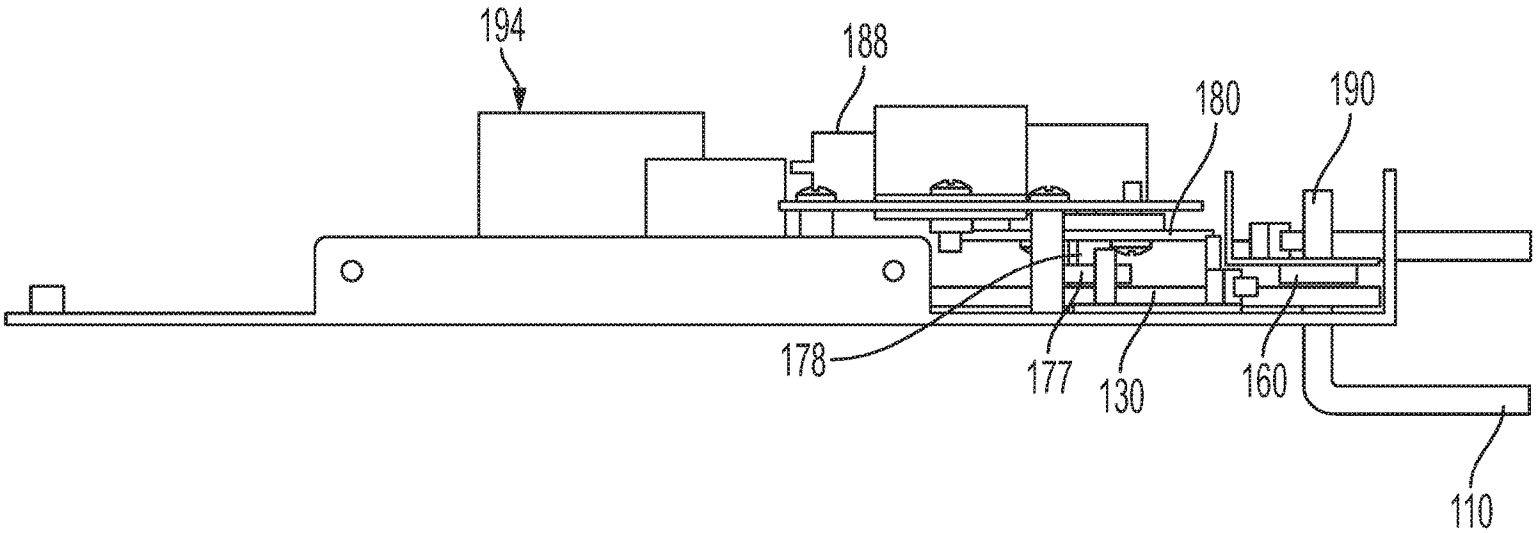
FIG. 12 illustrates a bottom view of components of the locking mechanism of FIG. 9.
Figure 13:
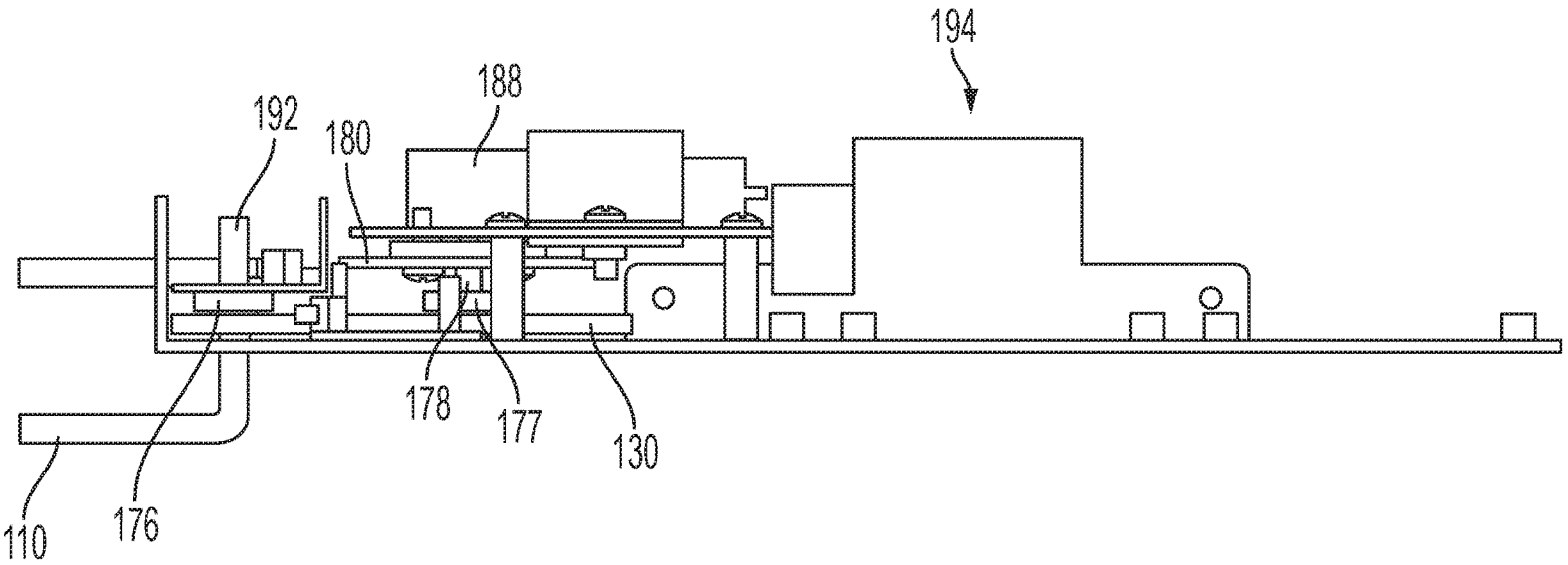
FIG. 13 illustrates a top view of components of the locking mechanism of FIG. 9.

FIGS. 6-8 illustrate the lock bar 130, a first modified washer 160 and a second modified washer 176 (a third modified washer 177, shown in FIG. 11, may also be used in conjunction with the cam shaft 178), as well as additional components of the locking mechanism 114. The first modified washer extends into the first aperture 132 of the lock bar 130 and the second modified washer 176 extends into the second aperture 134 of the lock bar 130. A cam shaft 178 is coupled to a cam wheel 180 and extends into the cam shaft aperture 136 of the lock bar 130. The locking mechanism 114 also includes an upper sensor 182 and a lower sensor 184 that detect the lock bar 130 when it is in an upper location and a lower position, respectively. The locking mechanism 114 further includes a catch loop sensor 186 that detects the catch loop 110 when the locking mechanism is in a locked configuration.

Figure 9:
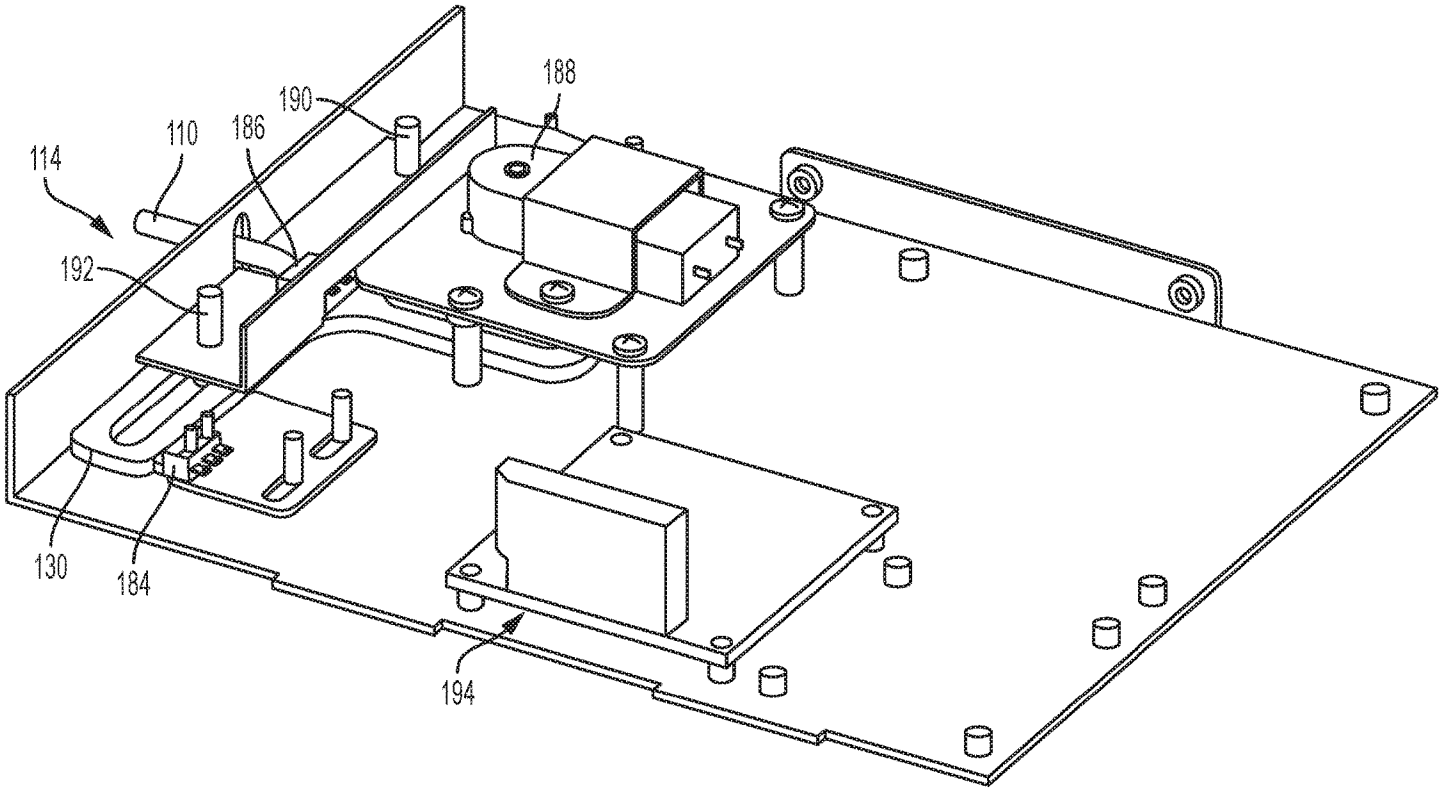
FIG. 9 illustrates a perspective view of components of a locking mechanism according to embodiments of the present invention.
Figure 10:
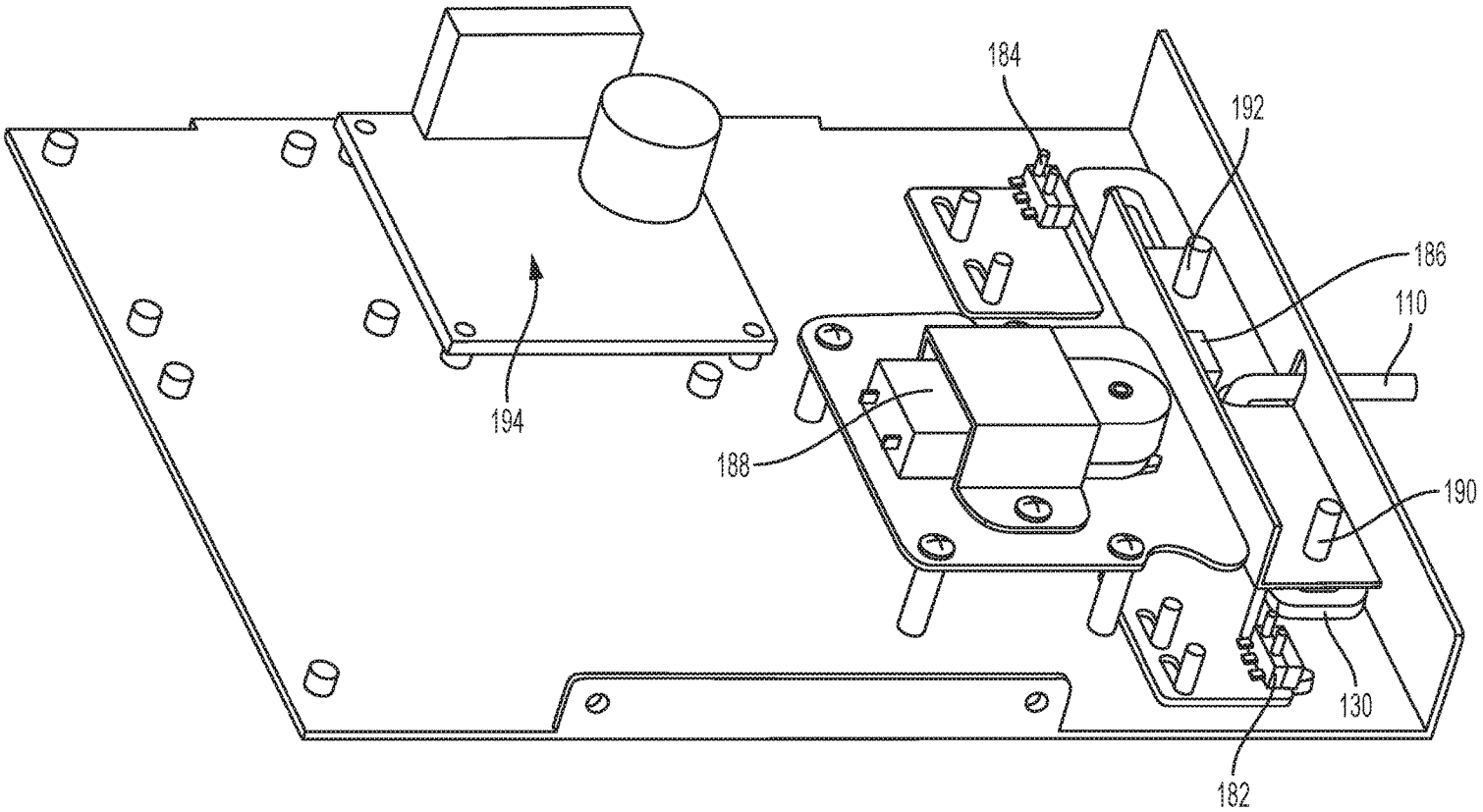
FIG. 10 illustrates an opposite partial perspective view of components of locking mechanism of FIG. 9.

FIGS. 6-8 also illustrate the locking mechanism 114 as it moves from a locked position (FIG. 6) to an unlocked position (FIG. 8). In FIG. 6, the cam wheel is in a "locked" position in which the cam shaft 178 is in a "6:00" position. In FIG. 7, the cam wheel 180 has rotated (e.g., due to an electric motor 188 as shown in FIG. 9) from that locked position into a "partially locked" position in which the cam shaft 178 is in a "9:00" position. By rotating the cam wheel 180, the cam shaft 178 forces the lock bar 130 upward as the modified washers 160, 162 prevent the lock bar 130 from moving horizontally or laterally. As the lock bar 130 moves upward, the catch loop 110 exits the second section 142 of the catch loop opening 138 and enters the first section 140 of the catch loop opening 138. As the lock bar 130 continues upward, the first section lower surface 144 forces the catch loop outwards. In FIG. 8, the cam wheel 180 has rotated into an "unlocked" position in which the cam shaft 178 is in the "12:00" position. With that movement, the lock bar 130 reaches its highest point and the first section lower surface 144 has pushed the catch loop 110 out of the catch loop opening 138. The locker door 104 may be opened to permit access to the locker bay 102.

In some embodiments, the locker door 104 includes a spring (e.g., as part of the hinge or hinges 108) that forces the locker door 104 towards the closed position. In those embodiments, the catch loop 110 will push against the outer surface of the lock bar 130 (e.g., just below the catch loop opening 138) or against a lower portion of the first section lower surface 144 of the catch loop opening 138 when the locking mechanism is in the unlocked position. To transition from the unlocked position (FIG. 8) to the locked position (FIG. 6), the cam wheel 180 continues to rotate clockwise. In other embodiments, the cam wheel 180 begins a counter-clockwise rotation. With rotation in either direction, the cam shaft 178 causes the lock bar 130 to slide down, such that the first section upper surface 146 of the catch loop opening 138 pulls the catch loop 110 deeper into the catch loop aperture 138. In those embodiments in which the locker door 104 includes a spring, the forces exerted by the spring on the door push the catch loop 110 deeper into the catch loop opening 138. Further rotation by the cam wheel 180 continues this motion until the cam wheel 180 returns to the "locked" position in which the cam shaft 178 is in the "6:00" position and the catch loop 110 is secured within the second section 142 of the catch loop opening 138.

In some embodiments, the dimensions of the lock bar 130 or catch loop opening 138 are selected to prevent injury, damage, or unauthorized entry into the locker bay 102 as the locking mechanism 114 secures the locker door 104. For example, the distance from the second section exterior side surface 148 of the catch loop opening 138 to an exterior surface (151 in FIG. 4) of the lock bar 130 may be substantially equal to or less than the thickness (113 in FIG. 2) of the locker door 104. In those embodiments, the inner surface 112 of the locker door will be adjacent to or flush with the locker bay 102 (e.g., the center bar 115 in FIG. 1). This eliminates a gap between the locker door 104 and the locker bay 102 before the electric motor (188 in FIG. 9) engages the lock bar 130, so that fingers or other objects are not left between the locker door 104 and the locker bay 102 as the motor 188 pulls the locker door 104 into the closed position.

FIG. 9 depicts the locking mechanism 114 with additional components, such as an electric motor 188 that drives the cam wheel 180 and pins 190, 192 that secure the first and second modified washers 160, 176, respectively. The locking mechanism 114 further includes a processor (not shown) that operates the electric motor 188 by executing instructions stored on a memory. The locking mechanism 114 may include components enabling wired or wireless communications with an external controller or with other locking mechanisms. In some embodiments, the locking mechanism may receive instructions from a local controller, while in other embodiments the locking mechanism may be controlled from a remote server.

In some embodiments, and as shown in FIG. 9, the locker bay 102 includes an object identifier 194. The object identifier 194 could include, for example, an RFID reader, a bar code reader, a camera, and/or other Near-Field Communications technologies. When an object is placed into the locker bay 102, the object identifier 194 interacts with the object (e.g., activates an RFID field to read an RFID tag, scans the object to read an attached barcode, takes a picture, and/or the like) to derive identifying information regarding the object. That identifying information may then be conveyed to external systems (e.g., a local control center or a remote server) for analysis or for further use. For example, the object may be a product incorporating an RFID chip into its packaging. The object identifier 194 uses its RFID reader to read identifying information from the product's RFID chip. The object identifier 194 may then transmit the identifying information to a central server.

Identifying objects placed within the locker bay 102 may be useful in many situations. For example, the locker bay 102 may be part of a vending module and the identifying information read from the product in the locker bay 102 may be used to verify the nature of the offered product or may be used to determine the price of the object in the locker bay 102. In some embodiments, the identifying information may be used to inventory the contents of the locker bay 102, determine the identity of new contents, and/or verify the identity of the contents prior to unlocking or dispensing the product. In another example, a delivery package may be placed into the locking module. The object identifier 194 interacts with the delivery package, for example, by reading a bar code placed on the outside of the package, and conveys the read bar code data to a central server. The central server checks the bar code data against a central database to confirm correct delivery or to record the delivered location. The central server may then transmit instructions to the locking mechanism 114 to secure the locker bay 102 and may also transmit a message to the intended recipient. The recipient then goes to the locker bay 102 and unlocks the locker bay 102, for example by presenting authorizing credentials at a local interface or by authorizing the central server to unlock the locker bay 102.

In some embodiments, the locker bay 102 operates as part of the system described in U.S. Provisional Patent Application No. 61/708,913, entitled Systems and Methods for Locking and Docking, filed on Oct. 2, 2012, which is hereby incorporated by reference in its entirety, or the locker bay 102 operates as part of the system described in U.S. patent application Ser. No. 14/044,714, entitled Systems and Methods for Locking and Docking, filed on Oct. 2, 2013, which is hereby incorporated by reference in its entirety. For example, the locking module 114 could operate as one or more Daughter Boards, Lock Control Boards, or Primary Lock Control Boards as described in that application. In addition, in some embodiments, the catch loop sensor 186 may operate as a Daughter Board (e.g., an ID Daughter Board) and incorporate an RFID reader as described in that application. As further examples, the lock module 100 of the present invention may incorporate Daughter Boards, such as the Sensory Daughter Boards described in that application, and the locking module 114 and the lock bar 130 may be adapted to secure a latching body as described in that application.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A system for storing goods, the system comprising:

a locker bay including an interior adapted to store goods;

a locker door pivotally coupled to the locker bay, the locker door being pivotable between an open position and a closed position, wherein the locker door permits access to the interior of the locker bay in the open position, and the locker door inhibits access to the interior of the locker bay in the closed position;

a catch;

a locking mechanism comprising:

a first aperture being elongated along a first longitudinal axis, the locking mechanism being movable along the first longitudinal axis relative to the locker bay and the locker door;

a second aperture being elongated along a second longitudinal axis, wherein the second longitudinal axis is different than the first longitudinal axis; and a surface defining a catch aperture that is configured to receive the catch to secure the locker door in the closed position; and a cam translatably received in the second aperture and translatable along the second longitudinal axis;

a prime mover coupled to the locking mechanism via the cam and the second aperture, whereupon rotation of the prime mover, the prime mover translates the cam in the second aperture along the second longitudinal axis and the cam thereby drives the locking mechanism in a first direction and a second direction parallel to the first longitudinal axis;

wherein, when the locking mechanism is driven in the first direction via the prime mover and the cam, the surface defining the catch aperture guides the catch towards a locked position in which the locker door is secured in the closed position, and when the locking mechanism is driven in the second direction the surface defining the catch aperture guides the catch towards an unlocked position in which the locker door is movable towards the open position.

2. The system of claim 1, wherein the prime mover comprises an electric motor.

3. The system of claim 1, wherein the surface of the locking mechanism defining the catch aperture includes a first portion and a second portion, the first portion being angled relative to the second portion, and wherein the second portion engages the catch in the locked position.

4. The system of claim 3, wherein, when the lock is driven in the first direction, the first portion of the surface defining the catch aperture forces the catch towards the locked position, and when the lock is driven in the second direction, the first portion of the surface defining the catch aperture forces the catch towards the unlocked position.

5. The system of claim 3, wherein the catch is biased to move along the first portion of the surface defining the catch aperture towards the locked position when the lock is driven in the first direction.

6. The system of claim 3, wherein the first portion of the surface defining the catch aperture is angled relative to the second portion of the surface defining the catch aperture by an angle of approximately 135 degrees.

7. A system for storing goods, the system comprising:

a locker bay including an interior adapted to store goods;

a locker door pivotally coupled to the locker bay and selectively movable to a closed position in which the locker door inhibits access to the interior of the locker bay;

a catch loop;

a locking mechanism including a lock bar, wherein the lock bar comprises:

a first aperture being elongated along a first longitudinal axis, the lock bar being movable along the first longitudinal axis relative to the locker bay and the locker door;

a second aperture being elongated along a second longitudinal axis, wherein the second longitudinal axis is different than the first longitudinal axis; and a catch loop aperture defined by at least a first portion and a second portion of the lock bar, the first portion being angled relative to the second portion, and the second portion configured to receive the catch loop to lock the locker door in the closed position;

a cam translatably received in the second aperture and translatable along the second longitudinal axis; and a prime mover coupled to the locking mechanism via the cam and the second aperture, whereupon rotation of the prime mover, the prime mover translates the cam in the second aperture along the second longitudinal axis and the cam thereby translatably drives the lock bar along the first longitudinal axis;

wherein, when the prime mover and the cam translatably drive the lock bar, the first portion of the catch loop aperture guides the catch loop in and out of the second portion of the catch loop aperture to lock the locker door in the closed position and unlock the locker door, respectively.

8. The system of claim 7, wherein the first portion is angled relative to the second portion by an angle of approximately 135 degrees.

9. The system of claim 7, wherein, when the prime mover translatably drives the lock bar, the first portion of the catch loop aperture forces the catch loop in and out of the second portion of the catch loop aperture to lock the locker door in the closed position and unlock the locker door, respectively.

10. The system of claim 7, wherein the locker door is biased towards the closed position such that the catch loop is biased against the first portion of the catch loop aperture and guided towards the second portion of the catch loop aperture when the prime mover translatably drives the lock bar to lock the locker door in the closed position.

11. The system of claim 7, wherein the prime mover translatably drives the lock bar between a first position and a second position, in the first position the catch loop being disposed apart from the catch loop aperture, in the second position the catch loop being received in the second portion of the catch loop aperture to lock the locker door in the closed position, and further comprising:

a first sensor for determining when the lock bar is disposed in the first position; and a second sensor for determining when the lock bar is disposed in the second position.

12. A system for storing goods, the system comprising:

a locker bay including an interior adapted to store goods;

a locker door pivotally coupled to the locker bay and selectively movable to a closed position in which the locker door inhibits access to the interior of the locker bay;

a catch loop;

a locking mechanism including a lock bar, wherein the lock bar comprises:

a first aperture being elongated along a first longitudinal axis, the lock bar being movable along the first longitudinal axis relative to the locker bay and the locker door;

a second aperture being elongated along a second longitudinal axis, wherein the second longitudinal axis is different than the first longitudinal axis; and a surface defining a catch loop aperture for receiving the catch loop to lock the locker door in the closed position;

a cam translatably received in the second aperture and translatable along the second longitudinal axis;

a prime mover coupled to the locking mechanism via the cam and the second aperture, whereupon rotation of the prime mover, the prime mover translates the cam in the second aperture along the second longitudinal axis and the cam thereby translatably drives the lock bar in a direction parallel to the first longitudinal axis; and an object identifier adapted to determine information regarding goods stored in the interior of the locker bay;

wherein, when the prime mover drives the lock bar in the direction parallel to the first longitudinal axis via the prime mover and the cam, the surface defining the catch loop aperture guides the catch loop in and out of the catch loop aperture to lock the locker door in the closed position and unlock the locker door, respectively.

13. The system of claim 12, wherein the object identifier is coupled to the locker bay within the interior of the locker bay.

14. The system of claim 12, wherein the object identifier is adapted to send the information regarding the goods stored in the interior of the locker bay to a remote server.

15. The system of claim 14, wherein the object identifier comprises an RFID reader adapted to determine information regarding the goods stored in the interior of the locker bay by interacting with an RFID chip associated with the goods.

16. The system of claim 14, wherein the object identifier comprises a bar code reader adapted to determine information regarding the goods stored in the interior of the locker bay by interacting with a bar code associated with the goods.

17. The system of claim 12, further comprising a remote server configured to receive the information regarding the goods stored in the interior of the locker bay from the object identifier.

18. The system of claim 17, wherein the remote server is adapted to perform at least one of: confirming delivery of the goods to the locker bay upon receiving the information regarding the goods from the object identifier, recording a location of the locker bay upon receiving the information regarding the goods from the object identifier, and transmitting a message to an intended recipient of the goods upon receiving the information regarding the goods from the object identifier.

* * * * *